US007971716B2

(12) United States Patent
Eaton

(10) Patent No.: US 7,971,716 B2
(45) Date of Patent: Jul. 5, 2011

(54) ADJUSTABLE INCLINED TOOL BOX

(76) Inventor: Michael R. Eaton, Wilmington, NC (US)

( * ) Notice: Subject to any disclaimer, the term of this patent is extended or adjusted under 35 U.S.C. 154(b) by 0 days.

(21) Appl. No.: 12/764,132

(22) Filed: Apr. 21, 2010

(65) Prior Publication Data

US 2010/0270193 A1 Oct. 28, 2010

Related U.S. Application Data

(60) Provisional application No. 61/171,733, filed on Apr. 22, 2009.

(51) Int. Cl.
*B65D 85/28* (2006.01)

(52) U.S. Cl. ..... 206/373

(58) Field of Classification Search ..... 206/372, 206/373

See application file for complete search history.

(56) References Cited

U.S. PATENT DOCUMENTS

| | | | | |
|---|---|---|---|---|
| 3,297,320 | A * | 1/1967 | Di Benedetto | 482/148 |
| 4,244,632 | A * | 1/1981 | Molinari | 312/231 |
| 4,303,158 | A | 12/1981 | Perkins | |
| 4,340,985 | A * | 7/1982 | Potter | 5/636 |
| 4,458,963 | A * | 7/1984 | Keddie | 312/237 |
| 4,744,613 | A | 5/1988 | Brantingham et al. | |
| 4,811,875 | A * | 3/1989 | DiSimone | 224/541 |
| 5,148,917 | A * | 9/1992 | LeBrun | 206/372 |
| 5,373,939 | A * | 12/1994 | Bloomgren | 206/341 |
| 5,494,305 | A * | 2/1996 | Chen | 280/32.6 |
| 5,609,322 | A * | 3/1997 | Bond | 248/558 |
| RE35,732 | E * | 2/1998 | Shockley | 296/136.07 |
| 5,971,102 | A * | 10/1999 | Brown | 182/129 |
| 7,510,078 | B2 | 3/2009 | Schmidt et al. | |
| 2005/0051980 | A1 * | 3/2005 | Melvin | 280/32.6 |
| 2009/0100596 | A1 * | 4/2009 | Weedling et al. | 5/81.1 HS |

FOREIGN PATENT DOCUMENTS

| | | | |
|---|---|---|---|
| EP | 0286750 | A1 | 10/1988 |

* cited by examiner

*Primary Examiner* — Jacob K Ackun, Jr.
(74) *Attorney, Agent, or Firm* — Ward and Smith, P.A.

(57) ABSTRACT

The present invention is related to an adjustable inclined tool box for holding tools. In addition, the user can comfortably lie on the tool box at an incline when working in a supine position. The incline of the tool box can be changed by adjusting the height of at least one height adjustable foot connected to the bottom of the tool box. An optional lip connected to the tool box and extending therefrom can be provided in order to provide a smooth transition from the back rest of the tool box to a cabinet space floor if being used for work under a cabinet.

20 Claims, 3 Drawing Sheets

ADJUSTABLE INCLINED TOOL BOX

CROSS-REFERENCE TO RELATED APPLICATIONS

This patent application is related to and claims benefit of priority to U.S. Provisional Application Ser. No. 61/171,733, filed Apr. 22, 2009, the entire disclosure of which is specifically incorporated by reference herein.

FIELD OF THE INVENTION

The present invention relates to tool boxes. More particularly, the invention relates to an adjustable inclined tool box with several compartments inside for holding the tools and an inclined top surface which allows the user to lie on the tool box at an incline when working in a supine position in confined spaces.

BACKGROUND OF THE INVENTION

Tool boxes are well known in the art and are commonly used by handymen, servicemen, and motor mechanics. Such boxes are generally in the form of an elongated rectangular or square shaped container having a bottom wall, a back wall, a front wall, a pair of side walls and a cover or a pair of covers which is/are usually hinged to the back wall or side walls. The cover may also have a handle or means for holding and carrying the tool box from one location to another. One or more trays are usually disposed inside the container. The tray may be completely removable or pivotally mounted so that it can be partially lifted out to gain access to the storage area underneath.

It is known that handymen, servicemen, or motor mechanics lying in a supine position under sinks, cabinets, cars or other enclosed spaces for an extended period of time have a high incidence of back and neck pain and injuries. These pains and injuries typically are caused by lying in the confined spaces for a long time and doing the repair work in an unsupported position, which is not only painful but very uncomfortable, thereby causing strain to the individual's neck and back. While various apparatuses and aids can be brought in to help support the handyman, these aids increase the burden of carrying additional material to the job site.

Efforts have been made in the prior art to overcome these types of problems by attempting to combine a tool box and a handyman support. For example, European Publication No. EP0286750 describes a flat board that can be used as a lounge to lie on under a car. When the lounge is folded up, a tool box is formed. However, this prior art has limitations because the tools cannot be stored in the apparatus when it is being used as a lounge and also since the lounge is not at an incline, it does not provide support to the neck and back while working in a supine position. Further, the box can be used either as a tool box or as a lounge. However, it is not possible to use the same device both as a lounge as well as a tool box simultaneously.

In another example, U.S. Pat. No. 4,340,985 discloses a tool box with a built-in head rest. However, this tool box provides a head rest but does not support the back and therefore would be uncomfortable to lie on. Further, the head rest occupies some additional space on the tool box.

Further, in the past when a person is working in confined spaces, for example under a sink, he or she has to lie over the "edge" of the cabinet base, wherein the cabinet space floor goes down at a 90 degree angle to the room floor. Even using a rolled up towel, or the like, can cause this edge to gouge into the person's back.

The prior art documents as discussed above disclose a combination tool box which can assist the individual working in confined spaces in a supine position for a long time. However, these prior arts do not disclose any such device which can be used as a tool box for holding the tools inside while simultaneously supporting the neck and back of the individual working in a supine position. Therefore, it would be advantageous to have a combination tool box with adjustable support to the back and neck for an individual working in a supine position.

SUMMARY OF THE INVENTION

The present invention provides an inclined tool box that is adjustable up to a varied range of height and incline. As such, the tool box is capable of carrying tools and can also be adjusted to form a comfortable support for the back and head of the user when the user is lying in a supine position.

In one embodiment, the tool box of the present invention is optimal for a user working in a confined space, such as under a sink, cabinet, a car or any other vehicle. The angle of inclination of the top surface of the tool box can be adjusted so that the tool box provides a comfortable support to the back and head of the user working in supine position in a confined space. The angle of inclination can be easily adjusted as required by lowering or raising the height of adjustable feet on the bottom of the tool box.

DETAILED DESCRIPTION OF THE INVENTION

It will readily be appreciated by those skilled in the art that the present invention is not limited to the specific embodiments herein shown. Thus, variations may be made within the scope and spirit of the accompanying claims without sacrificing the principal advantages of the invention.

The present invention provides an adjustable inclined tool box that can both carry tools and simultaneously can be used as a support for an individual who is working in a supine position. The tool box can be adjusted to a ranging variety of heights so that it is inclined at a comfortable angle for the individual.

In one exemplary embodiment, adjustable feet are located on the bottom surface of the tool box to adjust the tool box to a range of required heights. Therefore, the tool box can be adjusted and positioned in the most ergonomic way for the user. In this embodiment, the present invention provides an inclined tool box that can be used as a support for a user lying in a supine position, comprising a base box, an inclined back rest with a lid, and at least one pair of adjustable feet.

The tool box can carry tools, spare parts, and/or other objects for use in repair and maintenance projects. Examples of objects found in the tool box include, but are not limited to, hammers, screwdrivers, tape measures, pliers, drills, saws, levels, utility knives, tape, flashlights, washers, nuts, bolts, screws, and nails. The tool box can be compartmentalized to hold similar objects in similar areas of the tool box.

For a better understanding of the invention, reference will now be made to the drawings, and to the accompanying descriptive matter, in which there are described exemplary embodiments of the invention.

Figure 1:
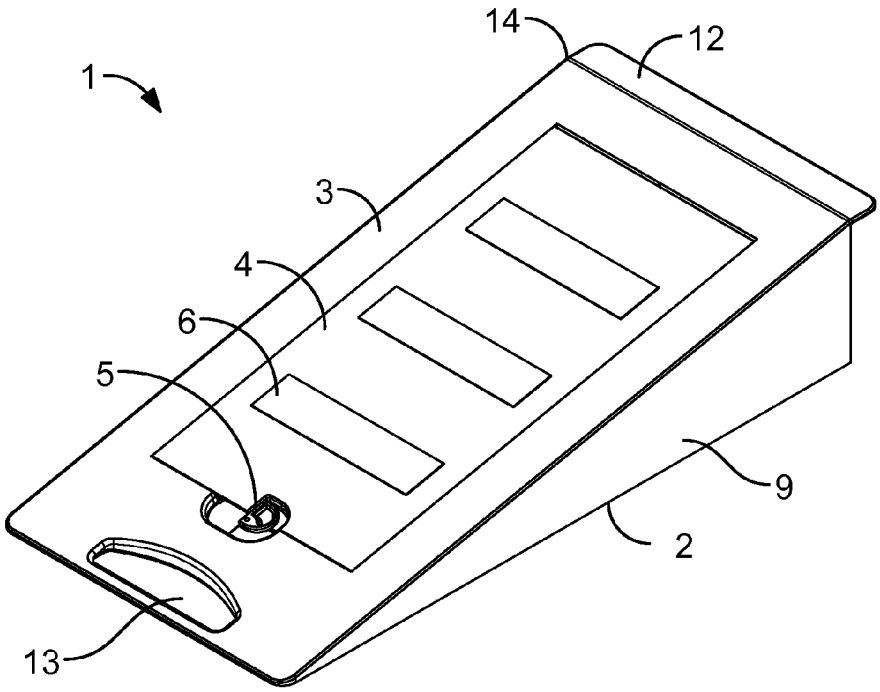
FIG. 1 shows a perspective view of a tool box of the present invention in which the lid is closed.
Figure 2:
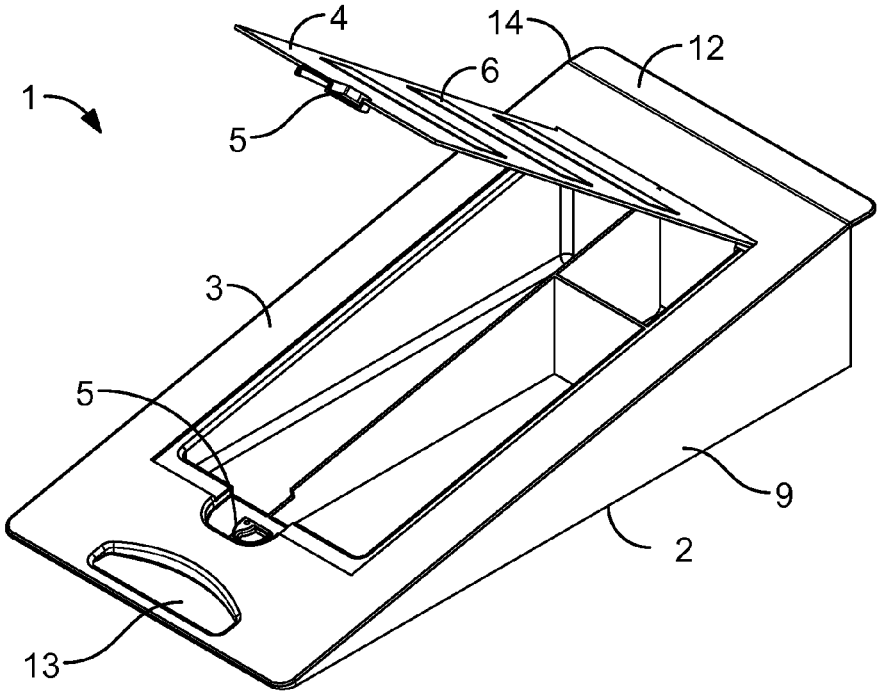
FIG. 2 illustrates a perspective view of a tool box in which the lid is open.

Referring to FIGS. 1 and 2, the toolbox 1 of the invention has a base portion and a top surface. The base portion comprises a base box 2 having a bottom surface 8, two side walls 9, 10 and a back wall 11, whereas, the top surface comprises a back rest 3 and a lid 4. In one embodiment, the bottom surface 8 has a horizontally placed rectangular structure attached to the side walls 9, 10 on both sides, to the back wall 11 at the back side and to the back rest 3 in the front side of the tool box. The back wall 11 has one top edge, one bottom edge and two side edges. The back wall may have a rectangular or square shape with a parallel top edge, a bottom edge and two side edges. The bottom edge of the back wall 11 is vertically attached to the bottom surface 8 of the base box 2. Both the side edges of back wall 11 are attached to the side walls 9 and 10 of the base box 2. The top edge of the back wall 11 is attached with the back rest 3.

A lip or tab 12 is attached at the intersection 14 of the back wall 11 and the back rest 3 and extends beyond the back rest 3. The lip 12 extending out from the high side of the back of the tool box is designed to fit over the edge of the lower part of a cabinet such as when the user opens the cabinet door and slides the tool box up against it. The lip 12 allows more comfort when lying on the tool box and inside of a cabinet, such as providing a smooth transition from the back rest 3 on to the cabinet space floor (where typically the edge can be an irritant to the user when in a supine position). The feet 7 (see FIGS. 4 and 5), such as adjustable feet, can be adjusted such that the lip 12 just rests on the cabinet space floor. The lip 12 can have gentle radius where the lip meets the main body of the tool box and therefore, the person lying on his or her back inside the cabinet space no longer has the cabinet edge gouging into his or her back. In one embodiment, it is envisioned that the lip 12 can be pivotally hinged at the point of its attachment 14 to the main body of the tool box and can be folded in the upper or lower direction. This helps to keep the tool box in a vertically standing position when the tool box is rested on its broader back side. It is also envisioned in another embodiment that the lip 12 can be fixedly attached at the point of attachment 14 to the main body, such as through being molded as essentially an extension of back rest 3. Since the lip 12 does not bear any weight, a smoother surface from the tool box surface into the cabinet space floor surface can be created by a straight or hinged attachment of the lip 12 to the main body of the tool box.

The side walls 9 and 10 are attached to the bottom surface 8 at the bottom edge, to the back wall 11 at the side edge, and to the back rest 3 at top edge. The side walls 9 and 10 have triangular structures inclined from the back to front direction of the tool box. Therefore, base box 2 has the maximum height at the back side and minimum height at the front side. The triangular structure of the side walls 9, 10 gives an inclined surface to the back rest 3 attached to the side walls 9, 10 and back wall 11. The top surface can have a hinged lid 4 attached to the back rest 3 for giving access to the inside chamber of the tool box 1. The inside chamber of the tool box may have a plurality of compartments for storing and holding the tools of different shapes and sizes and ensuring a proper place in the tool box for a specific type of tool. The lid 4 can be shut when the tool box is used as a support (as seen in FIG. 1) or can be opened when a tool is needed from the tool box (as seen in FIG. 2). The lid 4 can be further comprised of a clasp 5 which along with its counterpart on the back rest 3 keeps the lid 4 firmly shut when required. The upper surface of the tool box comprising the back rest 3 and the lid 4 may be smooth or rough. In one embodiment of the invention, the lid 4 has non-slip rubber pads or tape 6 on it to help keep the user positioned on the surface of the tool box while lying in the supine position. The front side of the tool box can have a semi-circular or other shaped opening 13 to handle and carry the tool box.

The tool box may be constructed of any typical material used to make tool boxes in general, such as wood, plastic, or metal. However, the tool box needs to be able to support the weight of a user lying against the tool box. The construction material of the tool box of the invention is not limited to only one material, but rather several different materials or a combination of different materials can be used for the purpose. For example, in one non-limiting embodiment, the base box 2 and the back rest 3 are made of a metal material, whereas the lid 4 and clasp 5 is constructed of plastic.

Figure 3:
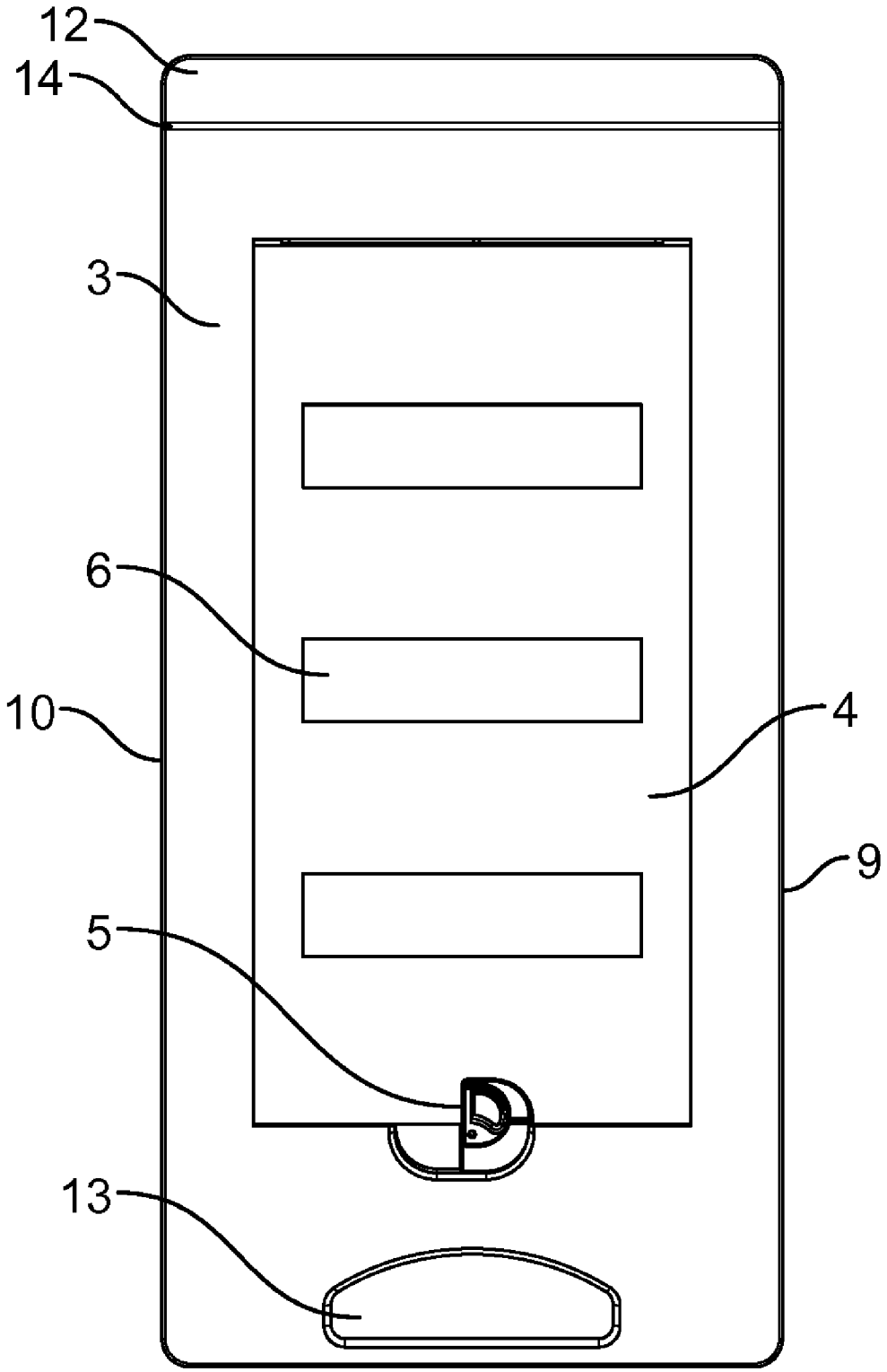
FIG. 3 demonstrates a top view of a tool box.

FIG. 3 illustrates the same embodiment of the tool box as shown in FIGS. 1 and 2 from a top view. The back rest 3 is illustrated along with the lid 4. On the lid 4 is a clasp 5 for keeping the lid closed along with its counterpart on the back rest 3. The optional non-slip rubber pads or tape 6 on the lid 4 are also shown in FIG. 3.

Figure 4:
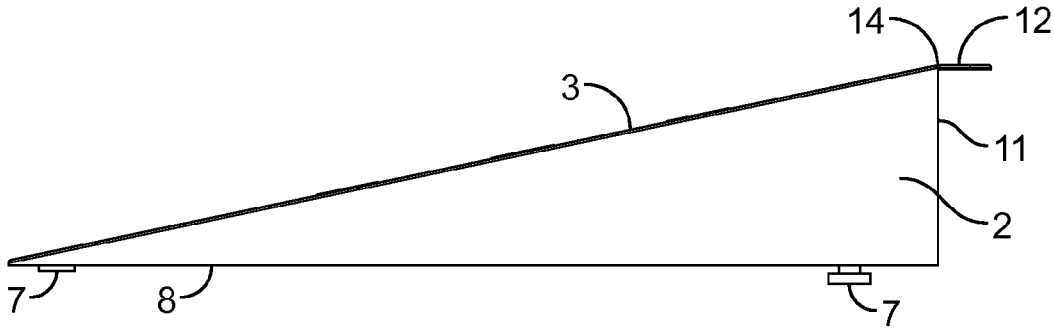
FIG. 4 shows a side view of a tool box.
Figure 5:
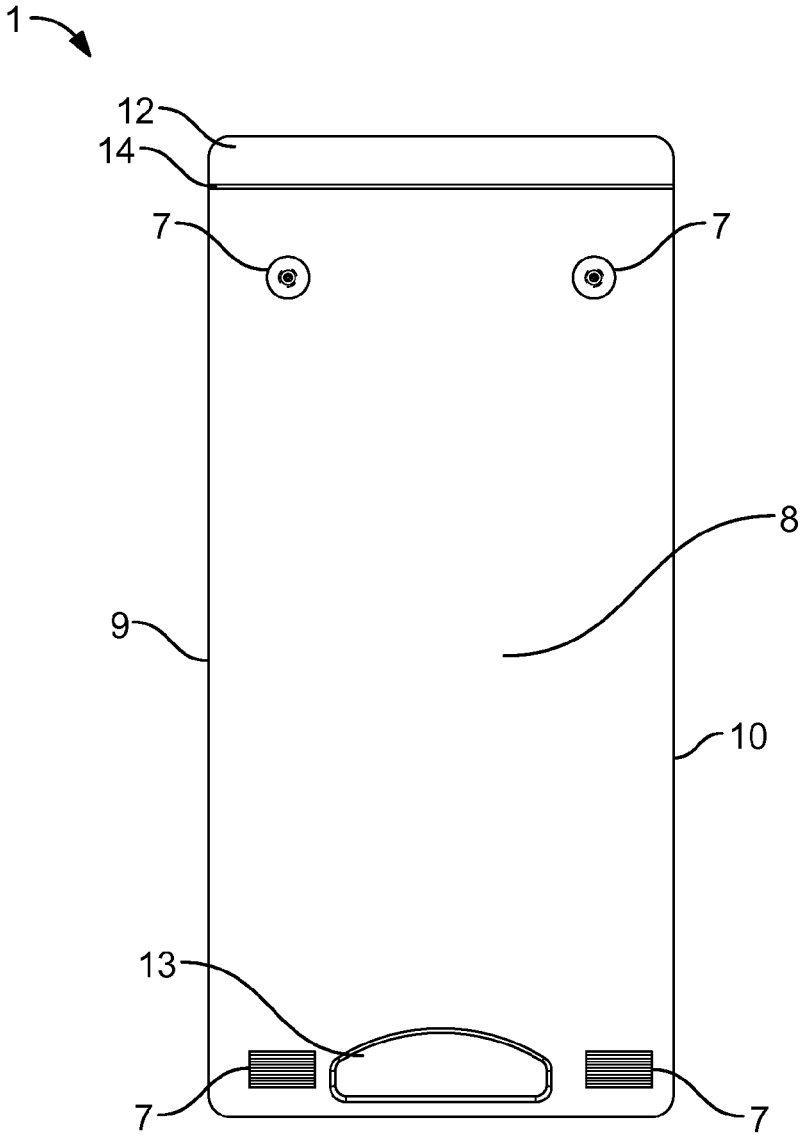
FIG. 5 illustrates a bottom view of a tool box.

FIG. 4 shows a side view of one embodiment of the tool box. From this view, the feet 7 located on the bottom surface 8 of the tool box 1 can be seen. The feet 7 may be present at all four corners of the bottom wall, and there may be a combination of fixed feet (such as, for example, non-slip rubber pads), adjustable feet, or even no feet. For example, as shown in FIGS. 4 and 5, one pair of fixed feet may be attached in the front side of the tool box and one pair of adjustable feet may be attached on back side of the tool box. The adjustable feet may be present at either of the sides also, depending upon the requirement of the user. The adjustable feet 7 are used to adjust the tool box to a range of heights in order to suit the user and position the tool box in the most ergonomic manner. These feet can be adjustable in a variety of manners. In one embodiment of the invention, the feet 7 can be adjusted through screw engagement with the bottom surface 8 of the tool box. In the embodiment shown in FIG. 4, the height of the top surface of the tool box and the relative inclination compared to the ground can be adjusted by adjusting the height of the adjustable feet 7 present toward the back portion of the tool box. The height of the back portion of the tool box and the angle of the back rest 3 relative to the ground will vary depending on the relative heights of each pair of adjustable feet present on the front and back portion of the tool box (or, alternatively, if adjustable feet are only located on the back portion of the tool box). The higher the feet are adjusted at the back portion of the tool box, the higher the height of the back portion of the tool box and the larger the angle will be between the back rest and the ground. This allows the user to change the incline of the back rest according to the working space available and the comfort of the user. The adjustment can also be made so that the lip 12 gently rests on the cabinet space floor when the tool box is pushed up against the cabinet, thereby providing a smooth transition from the back rest 3 of the tool box to the cabinet space floor.

FIG. 5 illustrates a bottom view of one embodiment of the tool box. The bottom surface 8 is shown comprising a pair of fixed feet 7 (such as, for example, non-slip rubber pads) towards the front portion of the tool box and a pair of adjustable feet 7 towards the back portion of the tool box and which allow the incline of the tool box (and back rest 3) to change. The lip 12 extending beyond the back rest 3 from the high side of the back of the tool box and the semi-circular opening 13 to handle and carry the tool box are also illustrated.

In one example, the tool box 1 has a length of approximately 59 cm (23.2 inches) and a width of approximately 28 cm (11 inches). The lid 4 has a length of approximately 40 cm (15.8 inches) and a width of approximately 20 cm (7.9 inches). Further, the clasp has a width of about 13 cm (5.1 inches). These dimensions of the tool box are only one example and are given for better understanding of the invention. There are many other examples that fit the present invention depending on the need of the user. The tool box of the present invention may be constructed with different dimensions as per user requirements. A tool box may need to be smaller due to the constraints of the space in which it will be used. The tool box may be bigger if bigger tools are required and the working space allows for a bigger tool box. In general, the dimensions of the tool box can vary from about 13 cm to about 100 cm in width and from about 30 cm to about 150 cm in length. The ratio of the dimensions can also vary and are not limited to the ratio shown in this example.

The foregoing detailed description of embodiments refers to the accompanying drawings, which illustrate specific embodiments of the invention. Other embodiments having different structures and operations do not depart from the scope of the present invention. The term "the invention" or the like is used with reference to certain specific examples of the many alternative aspects or embodiments of the applicant's invention set forth in this specification, and neither its use nor its absence is intended to limit the scope of the applicant's invention or the scope of the claims. This specification is divided into sections for the convenience of the reader only. Headings should not be construed as limiting of the scope of the invention. It will be understood that various details of the present invention may be changed without departing from the scope of the present invention. Furthermore, the foregoing description is for the purpose of illustration only, and not for the purpose of limitation.

What is claimed is:

1. An adjustable inclined tool box for carrying tools and providing support to a user lying in a supine position, the tool box comprising:

a) a base box comprising a bottom surface, a back wall, and two inclined side walls attached to said bottom surface;

b) an inclined back rest connected to said base box;

c) a lid operatively connected and comprising a portion of said back rest;

d) a lip extending horizontally from said back rest at an upper portion of said back wall; and e) at least one height adjustable foot operatively connected to said bottom surface.

2. The tool box as claimed in claim 1, wherein said back rest is connected to said back wall and side walls of said base box and has an inclined surface.

3. The tool box as claimed in claim 1, wherein said base box has several compartments for storing and holding tools of different shapes and sizes.

4. The tool box as claimed in claim 1, wherein said lid is a hinged lid operatively connected to said back rest for allowing access to the inside chamber of the tool box.

5. The tool box as claimed in claim 1, wherein said inclined back rest and lid have a smooth or rough surface.

6. The tool box as claimed in claim 1, wherein said inclined back rest and lid comprise non-slip rubber pads or non-slip tape to help keep the user positioned on the surface of the tool box while lying in a supine position.

7. The tool box as claimed in claim 1, wherein said inclined back rest has a clasp for releasably securing the lid in a closed position.

8. The tool box as claimed in claim 1, wherein the height of said at least one adjustable foot can be lowered or raised to change the angle of inclination of the back rest.

9. The tool box as claimed in claim 8, wherein said height of the back portion of the tool box and the angle of inclination of the back rest relative to the ground can be adjusted by adjustment of the at least one adjustable foot according to the availability of the space and comfort of the user.

10. An adjustable inclined tool box for carrying tools and providing support to a user lying in a supine position, the tool box comprising:

a) a base box comprising a bottom surface, a back wall, and two inclined side walls attached to said bottom surface;

b) an inclined back rest connected to said base box;

c) a lid operatively connected and comprising a portion of said back rest;

d) a lip extending from said back rest at an upper portion of said back wall where said lip is pivotally hinged at the intersection of said back wall and back rest and the lip extends beyond the back rest to allow fitting over the edge of the lower part of a cabinet when a user slides the tool box up against it; and e) at least one height adjustable foot operatively connected to said bottom surface.

11. An adjustable inclined tool box for carrying tools and providing support to a user lying in a supine position, the tool box comprising:

a) a base box comprising a bottom surface, a back wall, and two inclined side walls attached to said bottom surface;

b) an inclined back rest connected to said base box;

c) a lid operatively connected and comprising a portion of said back rest;

d) a lip extending from said back rest at an upper portion of said back wall where said lip is pivotally hinged at the intersection of said back wall and back rest and the lip extends beyond the back rest to allow fitting over the edge of the lower part of a cabinet when a user slides the tool box up against it, wherein said lip has a gentle radius at the point of its attachment to the back rest and can be folded in an upper or lower direction to keep the tool box in a vertical standing position when the tool box is rested on its back wall; and e) at least one height adjustable foot operatively connected to said bottom surface.

12. The tool box as claimed in claim 1, wherein said lip is fixedly attached at the intersection of the top of said back wall and back rest, and the lip extends beyond the back rest to allow fitting over the edge of the lower part of a cabinet when a user slides the tool box up against it.

13. The tool box as claimed in claim 12, wherein said lip and said back rest are formed as one continuous part.

14. The tool box as claimed in claim 1, wherein said tool box has a semi-circular opening in an end opposite the back wall for handling and carrying the tool box.

15. The tool box as claimed in claim 1, wherein said tool box is made of wood, plastic, metals, alloys, fibers or a combination of any of these.

16. An adjustable inclined tool box for carrying tools and providing support to a user lying in a supine position, the tool box comprising:

a) a base box comprising a bottom surface, a back wall, and two inclined side walls attached to said bottom surface;

b) an inclined back rest with an integrated lid, said back rest connected to said base box;

c) at least one height adjustable foot operatively connected to said bottom surface; and d) a lip extending horizontally from said back rest at an upper portion of said back wall and attached to the integrated lid with a pivoting hinge.

17. The tool box as claimed in claim 16, wherein said inclined back rest and lid comprise non-slip rubber pads or non-slip tape to help keep the user positioned on the surface of the tool box while lying in a supine position.

18. The tool box as claimed in claim 16, wherein said inclined back rest has a clasp for releasably securing the lid in a closed position.

19. The tool box as claimed in claim 16, wherein the height of said at least one adjustable foot can be lowered or raised to change the angle of inclination of the back rest.

20. The tool box as claimed in claim 19, wherein said height of the back portion of the tool box and the angle of inclination of the back rest relative to the ground can be adjusted by adjustment of the at least one adjustable foot according to the availability of the space and comfort of the user.

* * * * *